US007024801B2

(12) United States Patent
Hwang

(10) Patent No.: US 7,024,801 B2
(45) Date of Patent: Apr. 11, 2006

(54) DRYING APPARATUS HAVING FRONT SUPPORT MOUNTING ASSEMBLY

(75) Inventor: Sung Gi Hwang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/730,286

(22) Filed: Dec. 9, 2003

(65) Prior Publication Data

US 2004/0163275 A1 Aug. 26, 2004

(30) Foreign Application Priority Data

Dec. 10, 2002 (KR) ..... 10-2002-0078346

(51) Int. Cl.
*F26B 11/02* (2006.01)

(52) U.S. Cl. ..... 34/603

(58) Field of Classification Search ..... 34/601, 34/602, 603, 604, 605, 606
See application file for complete search history.

(56) References Cited

U.S. PATENT DOCUMENTS 2,679,112 A * 5/1954 Thompson ..... 34/562
2,716,820 A * 9/1955 Bourner ..... 34/82
2,737,729 A * 3/1956 Anthony ..... 34/602
2,996,809 A * 8/1961 Shapter ..... 34/75
3,066,422 A * 12/1962 Douglas Peyton ..... 34/82
3,784,273 A * 1/1974 Nikolai ..... 312/265.3
3,816,942 A * 6/1974 Smith ..... 34/242
4,586,269 A * 5/1986 St. Louis ..... 34/601
4,817,298 A * 4/1989 Toma ..... 34/595
5,257,448 A * 11/1993 Pearce et al. ..... 29/434
5,363,569 A * 11/1994 Kadakia ..... 34/601
5,548,908 A * 8/1996 Torborg et al. ..... 34/601
6,244,679 B1 * 6/2001 Robertson et al. ..... 312/334.1

* cited by examiner

*Primary Examiner*—S. Gravini
(74) *Attorney, Agent, or Firm*—Fleshner & Kim LLP

(57) ABSTRACT

In a drying apparatus having a drum and a front support mounting assembly, a front support is fixed directly to a cabinet using fixing brackets, to maintain a consistent distance between opposing surfaces of the drum and the front support. The front support mounting assembly includes a cabinet; a rotatable drum, horizontally installed within the cabinet as a drying chamber for holding an object to be dried, the rotatable drum having an open end; a front support for rotatably supporting the open end of the rotatable drum; and a fixing bracket for fixing the front support directly to the cabinet.

24 Claims, 6 Drawing Sheets

DRYING APPARATUS HAVING FRONT SUPPORT MOUNTING ASSEMBLY

This application claims the benefit of Korean Application No. 10-2002-0078346 filed on Dec. 10, 2002, which is hereby incorporated by reference.

BACKGROUND OF THE INVENTION

1. Field of the Invention

The present invention relates to a drying apparatus, such as a laundry dryer, having a front support mounting assembly, and more particularly to a drying apparatus having a front support mounting assembly, employing a fixing bracket for fixing a front support directly to a cabinet.

2. Discussion of the Related Art

Generally speaking, an apparatus for drying washed laundry, which may include a laundry dryer or a drum-type washing machine, performs drying by directing hot air generated from a heater into a rotating drying chamber, or drum, holding the laundry. Typically, the drum has an open end at its front and is installed horizontally with respect to a cabinet of the apparatus. The open front end of the drum should be rotatably supported on the front side of the cabinet, which has an entrance hole for providing access to the drum's interior. To support the open front end of the drum, the apparatus according to a related art is provided with a front support mounting assembly as illustrated in FIGS. 1 and 2, which show a laundry dryer having a front support mounting assembly.

Referring to FIG. 1, a laundry dryer according to a related art is comprised of a cabinet 26 having a laundry entrance 28*a* centrally formed in a front cabinet cover 28; a rotatable drum 8, horizontally secured within the cabinet, for holding laundry and having an open end and a closed end; and a front support 12, disposed between the drum and the front cabinet cover of the cabinet, for rotatably supporting the open end of the drum while allowing access to the drum's interior through a laundry opening 12*a*, which is centrally formed in the front support and has a slightly greater diameter than the laundry entrance of the front cabinet cover of the cabinet. The entrance 28*a* of the front cabinet cover 28 of the cabinet 26 receives a door 38 having a door glass 38*a* for viewing the interior of the drum 8 via the laundry opening 12*a* of the front support 12. The front support 12 is fixed to the front cabinet cover 28 using a plurality of coupling members 40, and then the front cabinet cover is mounted to the front of the cabinet 26 to complete the assembly, such that the front support is indirectly fixed to the cabinet via the front cabinet cover.

Referring to FIG. 2, the front support 12 comprises an annular guide 12*b*, protruding rearward, to provide rotatable support to the drum 8 by receiving the open end of the drum on a set of guide rollers (not shown) in contact with an outer surface of the open end of the drum. A seal 42 is provided for closing a gap between the drum 8 and the front support 12, to prevent escape of the hot air of the drying chamber, i.e., the drum. To facilitate the coupling between the drum 8 and the front support 12, at both the rotatably supported contact surface and the sealed gap, a consistent distance should be maintained for the opposing surfaces of the drum and the front support.

According to the front support mounting assembly constructed as above, however, the distance between the opposing surfaces of the drum 8 and the front support 12 is uneven due to the above-described indirect coupling, whereby the front support is fixed to the front cabinet cover 28 which is then fixed to the cabinet 26. As a result of the inconsistent distances, dryer operation and performance is degraded. Specifically, the installation of the front support 12 to the front cabinet cover 28 and the cabinet 26 is insecure or weakens over time, and the seal 42 tends to fail. Moreover, loading the front support 12 during assembly is cumbersome, which reduces manufacturing productivity accordingly.

SUMMARY OF THE INVENTION

Accordingly, the present invention is directed to a drying apparatus having a front support mounting assembly that substantially obviates one or more of the problems due to limitations and disadvantages of the related art.

An object of the present invention, which has been devised to solve the foregoing problem, lies in providing a drying apparatus having a front support mounting assembly, which maintains an even gap between the drum and the front support of the drum.

It is another object of the present invention to provide a drying apparatus having a front support mounting assembly, which improves manufacturing productivity and simplifies repair of the drying apparatus, by facilitating installation of the front support.

It is another object of the present invention to provide a drying apparatus having a front support mounting assembly, which enhances dryer performance by facilitating a seal between the drum and the front support.

It is another object of the present invention to provide a drying apparatus having a front support mounting assembly, in which improves dryer operation and reliability.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drying apparatus having a front support mounting assembly. The assembly comprises a cabinet; a rotatable drum, horizontally installed within the cabinet as a drying chamber for holding an object to be dried, the rotatable drum having an open end; a front support for rotatably supporting the open end of the rotatable drum; and means for fixing the front support directly to the cabinet. The fixing means comprises a cabinet-fixing flange, formed at a first end, for providing a first mounting surface for coupling with the mounting flange; a front support-fixing flange, formed at a second end, for providing a second mounting surface for coupling with the front support; and an extension link, extending from the cabinet-fixing flange to the front support-fixing flange, for compensating for a mounting offset between the first and second mounting surfaces.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations where possible.

The present invention is directed to a drying apparatus having a front support mounting assembly, embodied herein as a laundry dryer. The front support mounting assembly of the present invention may be adopted in a drum-type washing machine having a dryer function using a sealed drying chamber.

Figure 3:
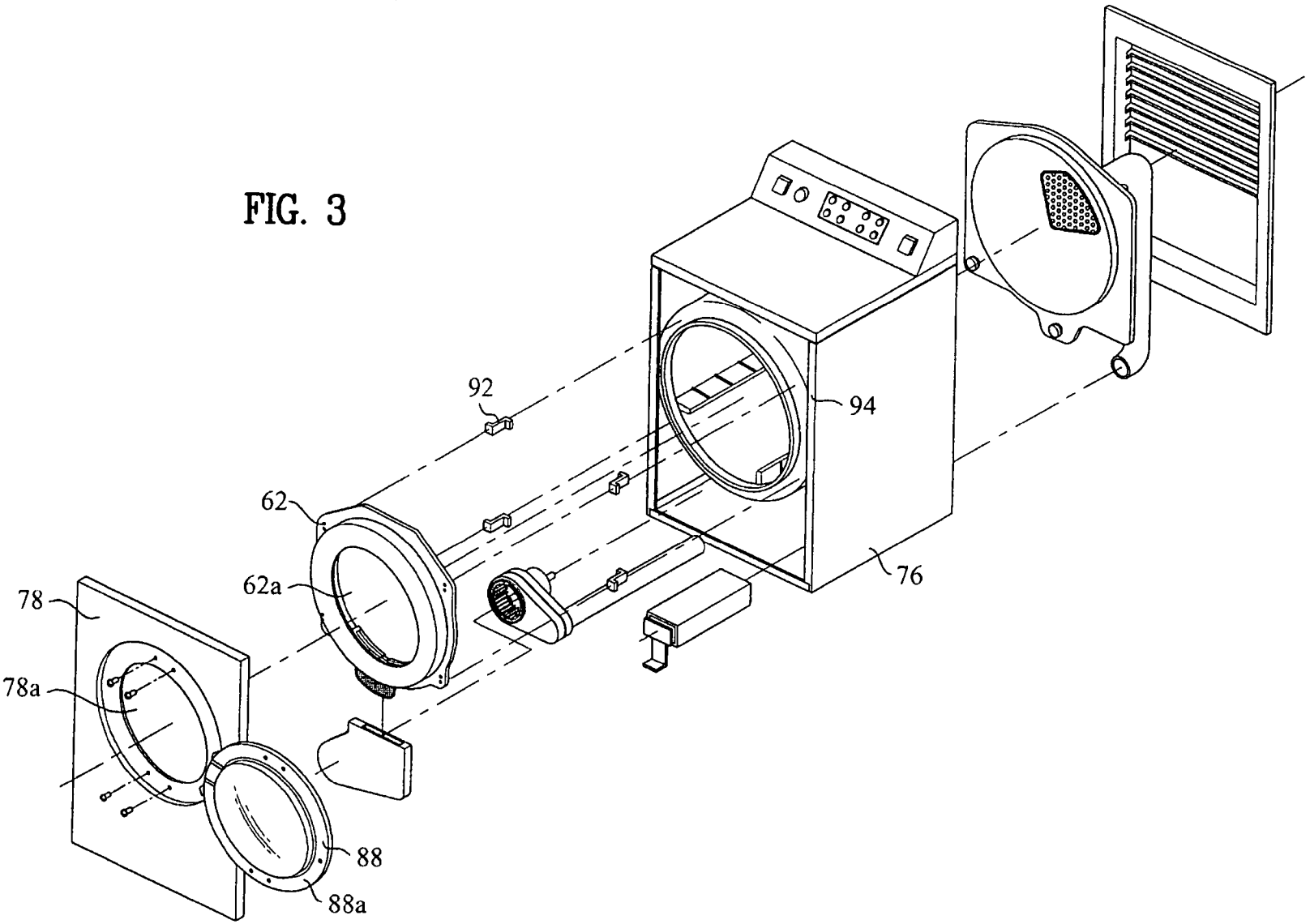
FIG. 3 is an exploded perspective view of a drying apparatus according to the present invention.
Figure 4:
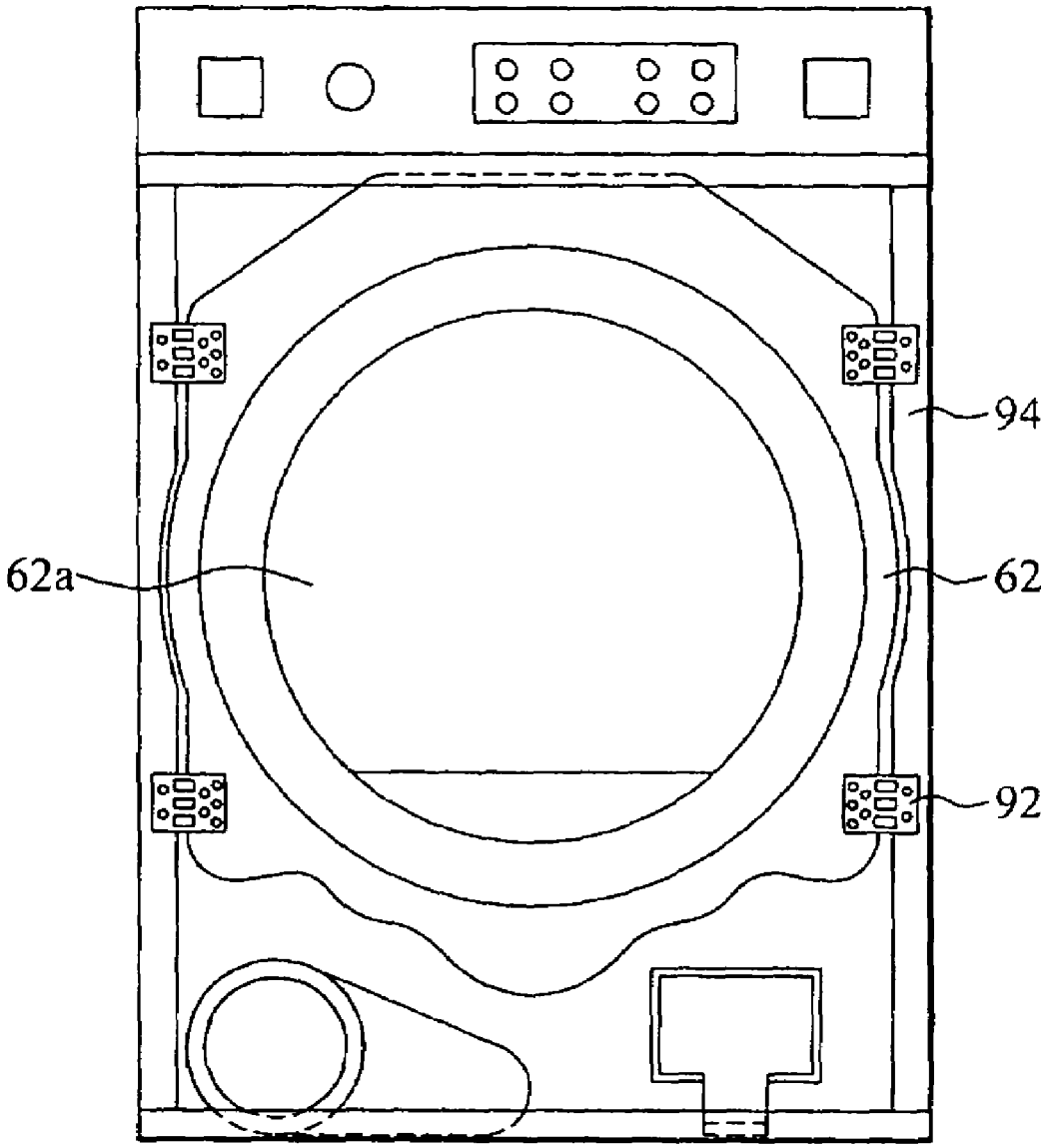
FIG. 4 is a front view of the drying apparatus of FIG. 3, shown in an intermediate stage of assembly to illustrate a front support mounting assembly according to the present invention.
Figure 5:
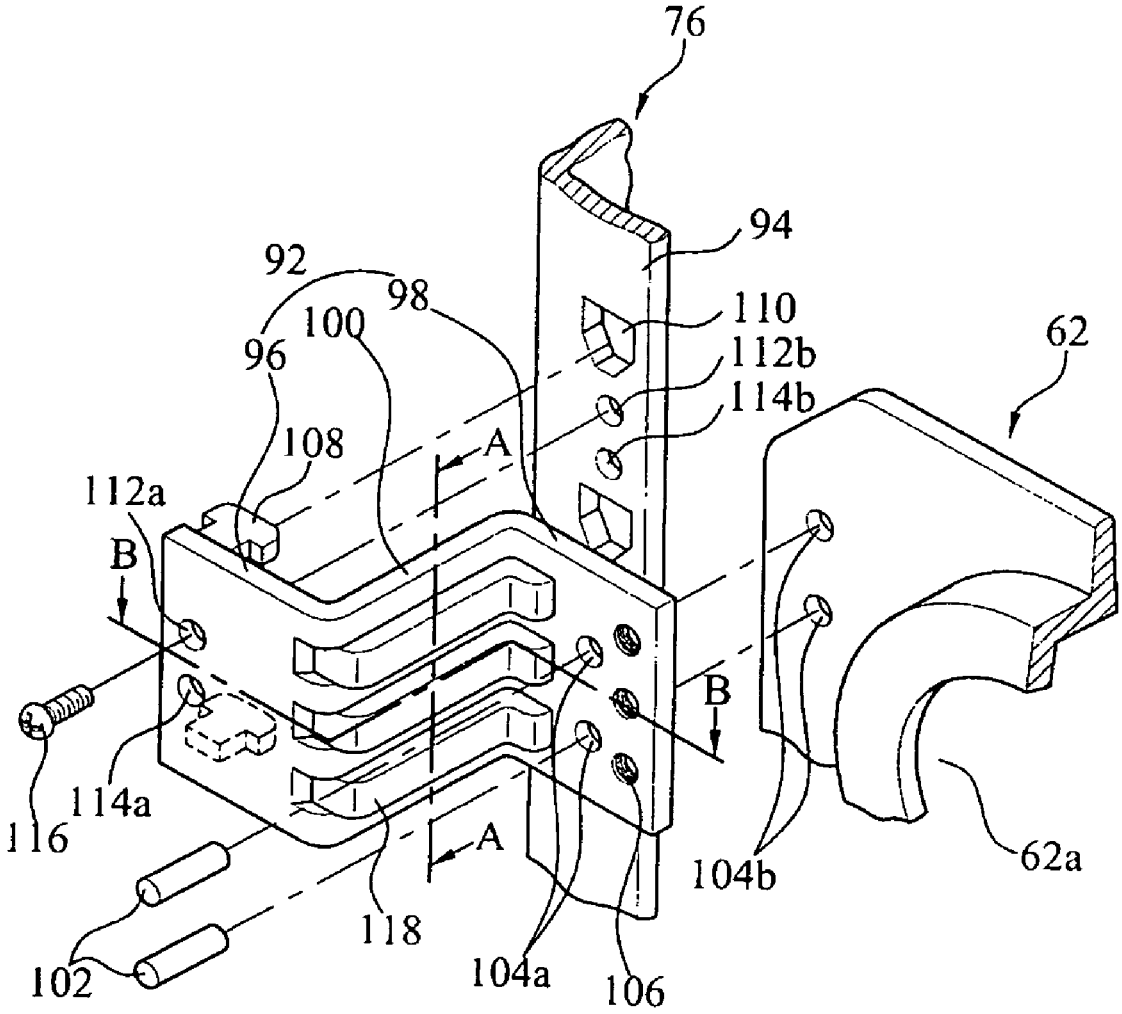
FIG. 5 is an exploded perspective view of the fixing means of a front support mounting assembly according to the present invention.

Referring to FIGS. 3–5, a laundry dryer according to the present invention is comprised of a cabinet 76 having a laundry entrance 78*a* centrally formed in a front cabinet cover 78; a rotatable drum 58, horizontally secured within the cabinet, for holding laundry and having an open end and a closed end; and a front support 62, disposed between the drum and the front cabinet cover, of the cabinet, for rotatably supporting the open end of the drum while allowing access to the drum's interior through a laundry opening 62*a*, which is centrally formed in the front support and has a slightly greater diameter than the laundry entrance of the front cabinet cover of the cabinet. The entrance 78*a* of the front cabinet cover 78 of the cabinet 76 receives a door 88 having a door glass 88*a* for viewing the interior of the drum 58 via the laundry opening 62*a* of the front support 62.

Figure 1:
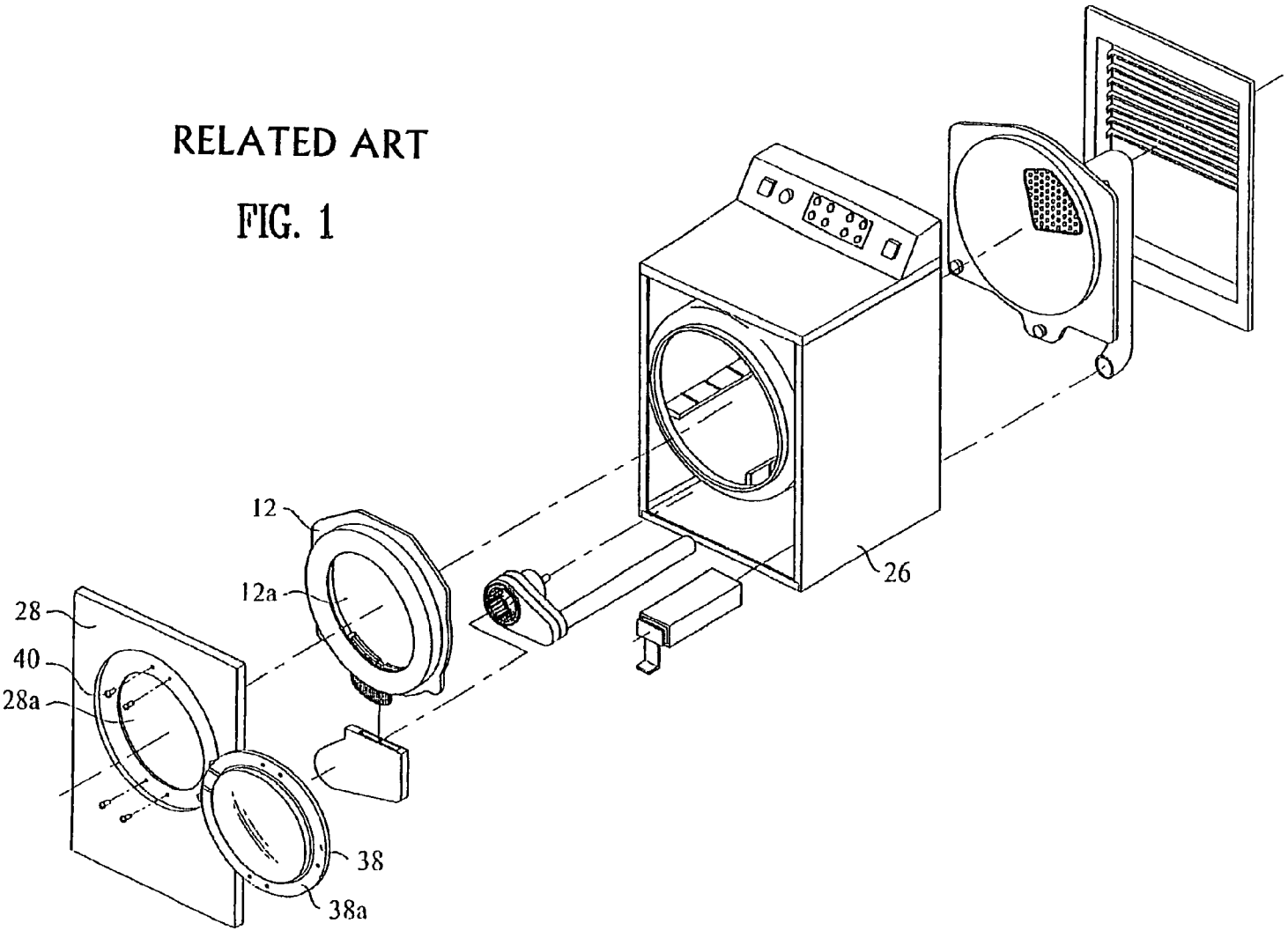
RELATED ART FIG. 1
FIG. 1 is an exploded perspective view of a laundry dryer according to a related art.
Figure 2:
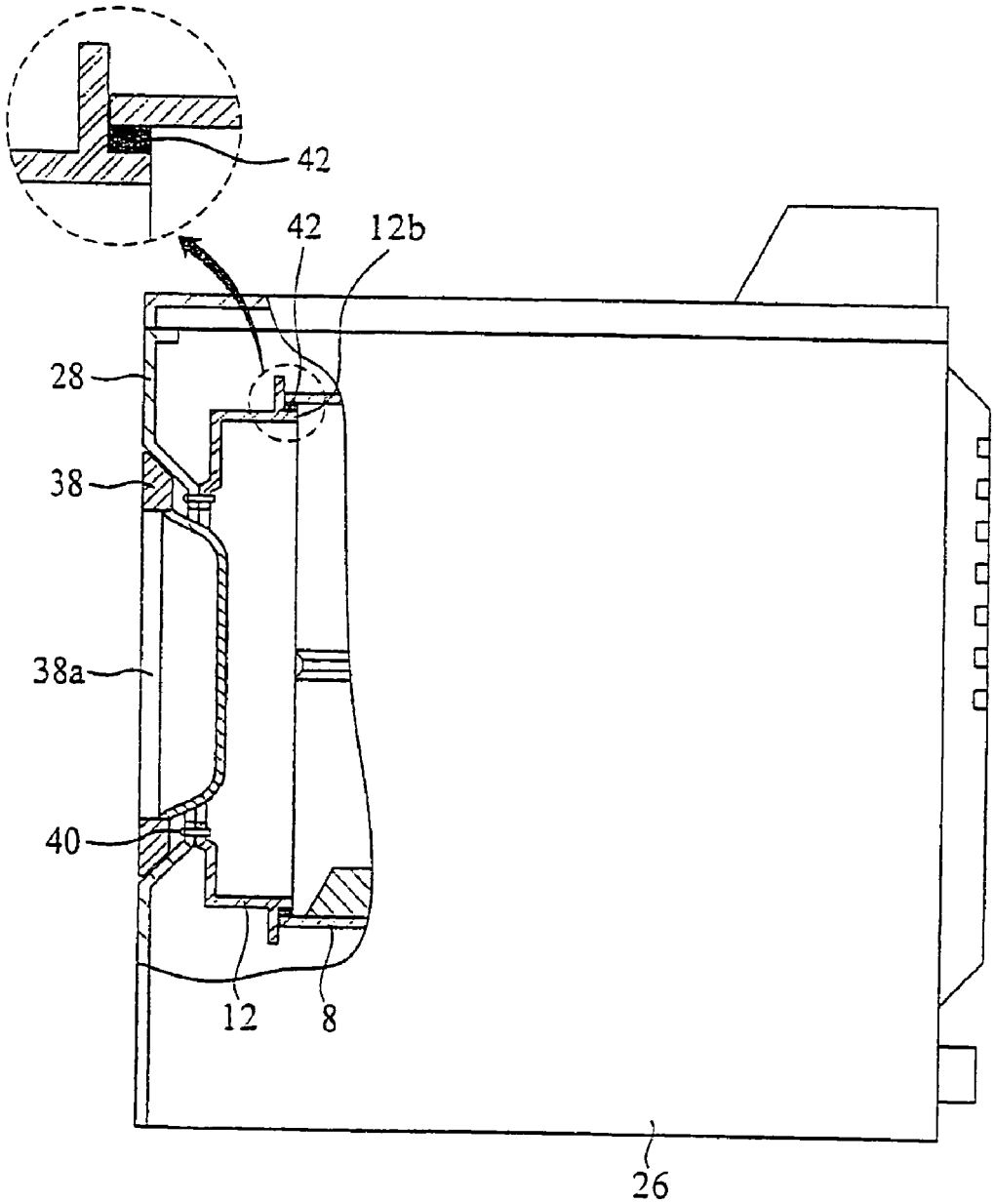
RELATED ART FIG. 2
FIG. 2 is a partially cutaway side view of the laundry dryer shown in FIG. 1, illustrating a front support mounting assembly according to a related art.

As in the case of the related art apparatus, the front support 62 comprises an annular guide, protruding rearward, to provide rotatable support to the drum 58 by receiving the open end of the drum on a set of guide rollers in contact with an outer surface of the open end of the drum. A seal (42 of FIG. 2) is provided for closing a gap between the drum 58 and the front support 62, to prevent escape of the hot air of the drum.

According to the front support mounting assembly of the present invention, the front support 62 is fixed directly to the cabinet 76, using a fixing means comprised of a plurality of fixing brackets 92. To this end, the cabinet 76 is provided with a mounting flange 94, which is a surface formed by inwardly bending a forward edge of the cabinet, and the front support 62 is provided with four corner flanges having a symmetrical arrangement for receiving a plurality of fixing brackets 92. Each fixing bracket 92 comprises a cabinet-fixing flange 96 formed at one end and a front support-fixing flange 98 formed at the other end. The ends of the fixing bracket 92 are respectively fixed to the mounting flange 94 of the cabinet 76 at a first mounting surface and to a corner flange of the front support 62 at a second mounting surface. Each fixing bracket 92 further comprises an extension link 100, extending from the cabinet-fixing flange 96 to the front support-fixing flange 98. The extension link 100 extends to a length compensating for a mounting offset between the first and second mounting surfaces. Since the drum 58 is securely installed within the cabinet 76 and the front support 62 is securely fixed to the cabinet, the length of the extension link 100 of the fixing means maintains a consistent distance between opposing surfaces of the drum and the front support.

The cabinet-fixing flange 96 of the fixing bracket 92 is bent from a front end of the extension link 100 in one direction, while the front support-fixing flange 98 of the fixing bracket is bent from a rear end of the extension link 100 in the opposite direction. The angles formed by the respective bends are substantially right angles with respect to the extension link 100 and are complementary angles, such that the cabinet-fixing flange 96 and front support-fixing flange 98 extend in opposite directions, thus providing for a substantially parallel coupling of the front support 62 with respect to the mounting flange 94 of the cabinet 76. That is, the first and second mounting surfaces are desirably parallel.

Figure 6A:
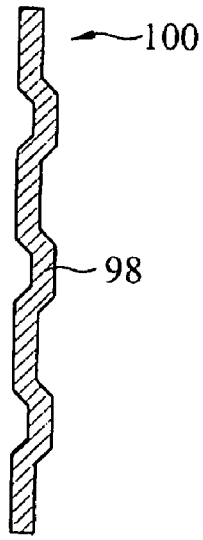
FIG. 6A is a cross-sectional view of the fixing bracket, cut along a line A—A in FIG. 5.
Figure 6B:
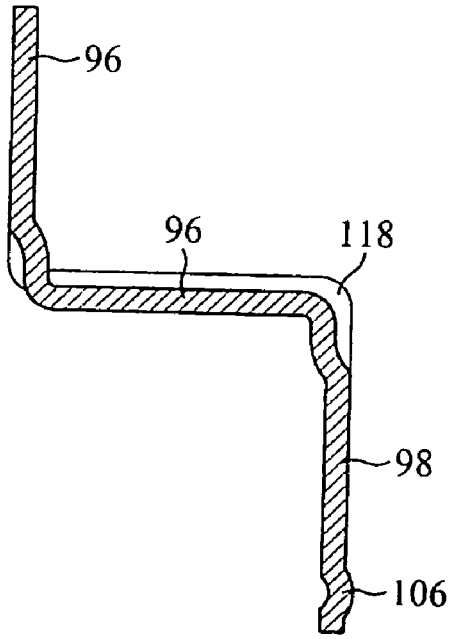
FIG. 6B is a cross-sectional view of the fixing bracket, cut along a line B—B in FIG. 5.

The fixing bracket 92 comprises at least one reinforcing bead 118, protruding from one side surface of the fixing bracket toward the laundry opening 62*a* of the front support 62 and having a channeled cross-section with a raised surface running parallel to the surface of the fixing bracket, to provide added support for the weight of the front support 62 and reinforce the rigidity of the coupling. Preferably, a plurality of reinforcing beads 118 are formed on the fixing bracket 92 and are arranged in rows. As shown in FIGS. 6A and 6B, each reinforcing bead 118 protrudes from the extension link 100 of the fixing bracket 92, with the forward end of the protrusion occurring at the cabinet-fixing flange 96 of the fixing bracket and the rearward end of the protrusion occurring at the front support-fixing flange 98 of the fixing bracket.

To fix the cabinet-fixing flange 96 to the cabinet 76, a pair of T-shaped hanging protrusions 108 are provided on a rear surface of the cabinet-fixing flange, respectively disposed at upper and lower hanging points, and a pair of slotted hanging holes 110, disposed to correspond to the hanging protrusions, are formed in the mounting flange 94, each providing a wide top opening tapered to a narrow bottom opening so that the hanging protrusions can be inserted in the top ends of the hanging holes to be caught in the bottom ends thereof under the weight of the fixing bracket 92. Thus, the fixing bracket 96 is hung on the cabinet 76. The thus-hung fixing bracket 92 is fixed to the cabinet 76 using a fixing member 116 secured into a set of fixing holes 112*a* and 112*b* respectively formed in the cabinet-fixing flange 96 and the mounting flange 94. In the event that the above set of fixing holes becomes excessively worn through repeated use, or is damaged, a spare set of fixing holes 114*a* and 114*b* may be adjacently provided.

To fix the front support-fixing flange 98 to the front support 62, the fixing bracket 92 should be properly oriented with respect to the front support. Thus, at least two sets of jig holes 104*a* and 104*b*, for receiving jig pins 102 are correspondingly formed in the front support-fixing flange 98 and the front support 62. The front support-fixing flange 98 may be fixed to the front support 62 by welding or by at least one coupling means (not shown) comprised of a fixing hole and a fixing member, such as fixing hole 112*a* and 112*b* and fixing member 116, since it would be advantageous for the front support-fixing flange to be separable from the front support. To facilitate welding, a plurality of welding protrusions 106, protruding toward the front support 62, are provided on a rear surface of the front support-fixing flange 98, to be welded to the front support.

In assembling a laundry dryer adopting the present invention, the jig holes 104*b* of the front support 62 are aligned with the jig holes 104*a* of the front support-fixing flange 98, and the jig pins 102 are inserted. With the fixing bracket 92 thus positioned, the welding protrusions 106 are welded to the front surface of a corner flange of the front support 62, using for example an arc welding technique. Each fixing brackets 92 is similarly fixed to a corresponding corner flange of the front support 62.

Subsequently, the front support 62 and fixing bracket 92 assembly is positioned with respect to the cabinet 76 at the mount flange 94 provided on the cabinet's forward edge, while inserting the guide protrusion (12*b* of FIG. 2) into the open end of the drum 58. In doing so, the hanging protrusions 108 of the cabinet-fixing flange 96 are respectively inserted into the wide top ends of the hanging holes 110 of the mounting flange 94 and lowered so that the front support 62 hangs on the front of the cabinet 76. Then, the fixing member 116 is fitted to the fixing holes 112*a* and 112*b* for each fixing bracket 92. The spare fixing holes 114*a* and 114*b* are left open.

By adopting the above-described front support mounting assembly to a laundry dryer according to the present invention, the front support is fixed directly to the cabinet using the fixing brackets, while maintaining a consistent distance between opposing surfaces of the drum and the front support. In doing so, manufacturing productivity is improved and repair of the drying apparatus is simplified, by facilitating installation of the front support. In addition, dryer performance is enhanced by facilitating a seal between the drum and the front support, and dryer operation and reliability are improved by providing a secure installation of the front support.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A drying apparatus having a front support mounting assembly, the assembly comprising:

a cabinet;

a rotatable drum, horizontally installed within said cabinet as a drying chamber for holding an object to be dried, said rotatable drum having an open end;

a front support which is an annular structure having front and back ends, wherein the back end rotatably supports the open end of said rotatable drum; and means for fixing said front support directly to said cabinet, wherein said cabinet comprises a mounting flange for receiving said fixing means wherein said fixing means comprises:

a cabinet-fixing flange, formed at a first end, for providing a first mounting surface for coupling with said mounting flange; and a front support-fixing flange, formed at a second end, for providing a second mounting surface for coupling with said front support wherein said cabinet-fixing flange comprising a pair of hanging protrusions formed on a rear surface, and wherein said mounting flange of said cabinet has a pair of hanging holes for respectively receiving said hanging protrusions.

2. The drying apparatus as claimed in claim 1, said fixing means further comprising an extension link, extending from said cabinet-fixing flange to said front support fixing flange, for compensating for a mounting offset between the first and second mounting surfaces.

3. The drying apparatus as claimed in claim 2, wherein said cabinet-fixing flange and said front support-fixing flange are respectively connected to said extension link to form predetermined angles.

4. The drying apparatus as claimed in claim 3, wherein the predetermined angles are complimentary right angles providing a substantially parallel coupling of said front support with respect to said mounting flange.

5. The drying apparatus as claimed in claim 2, wherein at least one reinforcing bead is formed on said extension link of said fixing means, for supporting said front support and reinforcing the coupling of said front support to said mounting flange of said cabinet.

6. The drying apparatus as claimed in claim 2, wherein a plurality of reinforcing beads are formed on said extension link of said fixing means, to be arranged in rows, for supporting said front support and reinforcing the coupling of said front support to said mounting flange of said cabinet.

7. The drying apparatus as claimed in claim 1, wherein said pair of hanging protrusions each have a T-shaped configuration and wherein each of the hanging holes of said mounting flange is formed to have a wide top end and a narrow bottom end, so that the T-shaped hanging protrusions can be respectively inserted in the top ends to be caught in the bottom ends.

8. The drying apparatus as claimed in claim 1, said fixing means further comprising at least one fixing member for fixing said cabinet-fixing flange of said fixing means to said mounting flange of said cabinet via at least one set of fixing holes respectively formed in said cabinet-fixing flange and said mounting flange.

9. The drying apparatus as claimed in claim 8, wherein at least one spare set of fixing holes are respectively formed in said cabinet-fixing flange and said mounting flange, adjacent the one set of fixing holes, for alternatively receiving the at least one fixing member.

10. The drying apparatus as claimed in claim 1, said front support-fixing flange comprising a plurality of welding protrusions for being welded to said front support.

11. The drying apparatus as claimed in claim 1, wherein said front support-fixing flange and said front support are each provided with at least two jig holes for respectively receiving at least two jig pins to establish a fixing position of said front support with respect to the fixing means.

12. The drying apparatus as claimed in claim 11, said front support-fixing flange comprising a plurality of welding protrusions for being welded to said front support.

13. The drying apparatus as claimed in claim 1, wherein said fixing means is provided at a plurality of mounting positions on said mounting flange of said cabinet.

14. The drying apparatus as claimed in claim 13, wherein the plurality of mounting positions are symmetrically arranged.

15. The drying apparatus as claimed in claim 13, wherein said front support is provided with four corner flanges.

16. The drying apparatus as claimed in claim 15, wherein the plurality of mounting positions correspond to the four corner flanges of said front support.

17. A drying apparatus having a front support mounting assembly, comprising:

a cabinet;

a rotatable drum horizontally installed within said cabinet as a drying chamber for holding an object to be dried, said rotatable drum having an open end;

a front support for rotatably supporting the open end of said rotatable drum; and a plurality of fixing brackets for fixing said front support directly to said cabinet, wherein said cabinet has a forward edge bent to form a mounting flange for receiving at least one of said plurality of fixing brackets, and the at least one of said plurality of brackets comprises:

a cabinet-fixing flange, formed at a first end, for providing a first mounting surface for coupling with said mounting flange; and a front support-fixing flange, formed at a second end, for providing a second mounting surface for coupling with said front support.

18. The drying apparatus as claimed in claim 17, wherein the forward edge of said cabinet is bent inwardly.

19. The drying apparatus as claimed in claim 17, further comprising:

a front cabinet cover, separable with respect to said cabinet, that can be mounted to the mounting flange of said cabinet after said front support is fixed to said cabinet.

20. The drying apparatus as claimed in claim 19, wherein, when said front cabinet cover is mounted to the mounting flange, said front support is disposed between said rotatable drum and said front cabinet cover.

21. The drying apparatus as claimed in claim 19, wherein said front support remains fixed to said cabinet irrespective of said front cabinet cover being mounted to said cabinet.

22. The drying apparatus as claimed in claim 17, wherein said plurality of fixing brackets maintains a consistent distance between opposing surfaces of the drum and the front support.

23. A drying apparatus having a front support mounting assembly, the assembly comprising:

a cabinet having a forward edge formed as a mounting flange;

a rotatable drum, horizontally installed within said cabinet as a drying chamber for holding an object to be dried, said rotatable drum having an open end;

a front support for rotatably supporting the open end of said rotatable drum; and means for fixing said front support directly to the mounting flange of said cabinet, wherein said fixing means is a plurality of brackets, and each of said plurality of brackets comprises:

a cabinet-fixing flange, formed at a first end, for providing a first mounting surface for coupling with said mounting flange; and a front support-fixing flange, formed at a second end, for providing a second mounting surface for coupling with said front support.

24. The drying apparatus as claimed in claim 23, wherein the forward edge of said cabinet is bent inwardly from opposing sides of said cabinet, to form the mounting flange on each opposing side, and wherein the mounting flange of each opposing side receives at least one of said plurality of brackets.

* * * * *